US005704845A

United States Patent [19]

Boyte

[11] Patent Number: 5,704,845

[45] Date of Patent: Jan. 6, 1998

[54] GOLF CLUB TEACHING AND GRIPPING DEVICE

[76] Inventor: Wayne S. Boyte, 2241 Florencita Dr., Apt. D, Montrose, Calif. 91020

[21] Appl. No.: 758,694

[22] Filed: Dec. 3, 1996

[51] Int. Cl.[6] ..... A63B 69/36

[52] U.S. Cl. ..... 473/205; 473/206

[58] Field of Search ..... 473/205, 206, 473/212

[56] References Cited

U.S. PATENT DOCUMENTS

| | | | |
|---|---|---|---|
| 1,587,287 | 6/1926 | Denman | 473/205 |
| 1,692,201 | 11/1928 | Denman et al. | 473/205 |
| 3,951,416 | 4/1976 | Koch et al. | 473/212 |

*Primary Examiner*—George J. Marlo

[57] ABSTRACT

A golf club teaching and gripping device for properly gripping a golf club without risk of slippage includes a resilient ring dimensioned for receiving at least three fingers on an upper hand of a golfer. The resilient ring has planar inner and outer portions and arcuate upper and lower portions together forming a continuous ring for receiving the fingers of the golfer. Attached to the resilient ring is a golf club gripping portion comprising a generally U-shaped member fabricated of a pliable material. The U-shaped member has an arcuate base portion and a pair of upwardly extending and inwardly curving free portions. An outer surface of the arcuate base portion is secured to the planar inner portion of the resilient ring of the finger coupling portion and extends between the fingers and a palm of the golfer when the finger coupling portion is in place on the upper hand of the golfer. The U-Shape member receives the handle of a golf club between the free portions thereof for securement to the handle and coupling with the upper hand of the golfer.

1 Claim, 3 Drawing Sheets

FIG 3
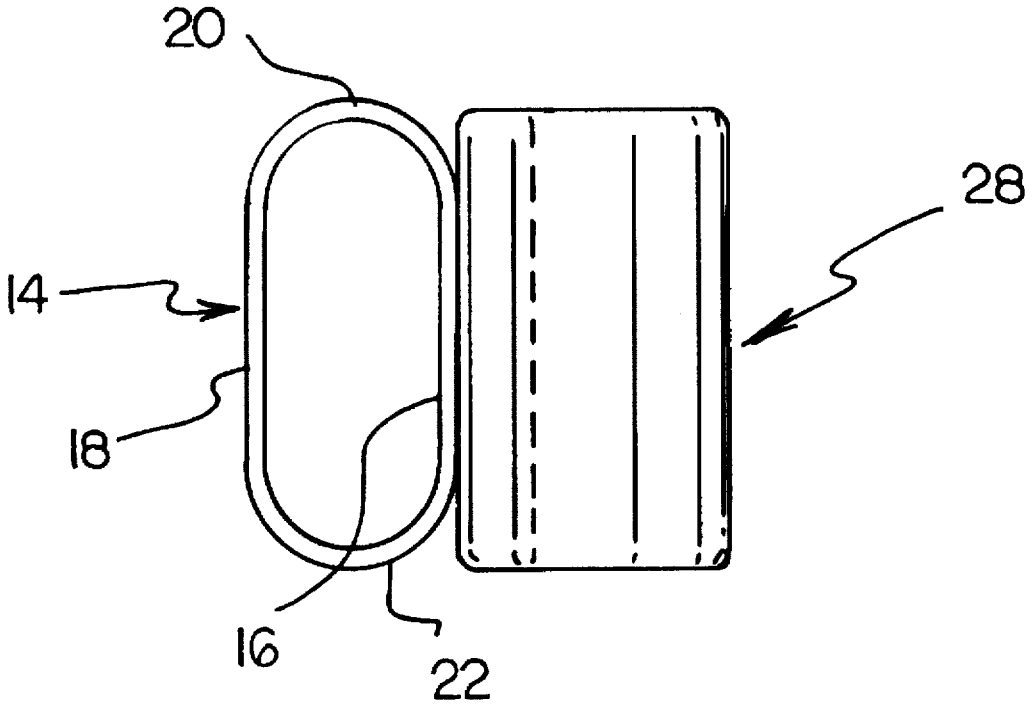
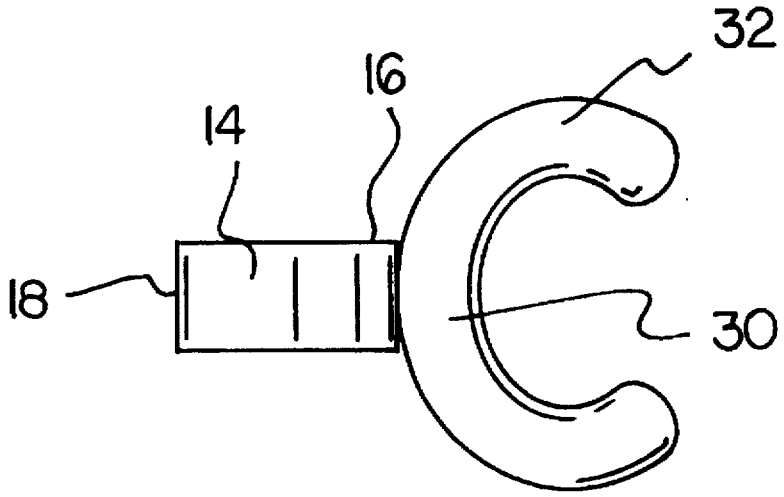
FIG 4

GOLF CLUB TEACHING AND GRIPPING DEVICE

BACKGROUND OF THE INVENTION

1. Field of the Invention

The present invention relates to a golf club teaching and gripping device and more particularly pertains to properly gripping a golf club without risk of slippage with a golf club teaching and gripping device.

2. Description of the Prior Art

The use of golf gloves is known in the prior art. More specifically, golf gloves heretofore devised and utilized for the purpose of aiding in handling a golf club are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, the aforementioned patents do not describe a golf club teaching and gripping device for properly gripping a golf club without risk of slippage.

In this respect, the golf club teaching and gripping device according to the present invention substantially departs from the conventional concepts and designs of the prior art, and in doing so provides an apparatus primarily developed for the purpose of properly gripping a golf club without risk of slippage.

Therefore, it can be appreciated that there exists a continuing need for new and improved golf club teaching and gripping device which can be used for properly gripping a golf club without risk of slippage. In this regard, the present invention substantially fulfills this need.

SUMMARY OF THE INVENTION

In the view of the foregoing disadvantages inherent in the known types of golf gloves now present in the prior art, the present invention provides an improved golf club teaching and gripping device. As such, the general purpose of the present invention, which will be described subsequently in greater detail, is to provide a new and improved golf club teaching and gripping device and method which has all the advantages of the prior art and none of the disadvantages.

To attain this, the present invention essentially comprises a finger coupling portion comprising a resilient ring dimensioned for receiving a last three fingers on an upper hand of a golfer. The resilient ring includes planar inner and outer portions and arcuate upper and lower portions. The device includes a golf club gripping portion comprising a generally U-shaped member fabricated of a pliable material. The U-shaped member has an arcuate base portion and a pair of upwardly extending and inwardly curving free portions. An outer surface of the arcuate base portion is secured to the planar inner portion of the resilient ring of the finger coupling portion. The golf club gripping portion has a length equal to a length of the finger coupling portion. The U-shaped member receives a handle of a golf club between the free portions thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club teaching and gripping device which has all the advantages of the prior art golf gloves and none of the disadvantages.

It is another object of the present invention to provide a new and improved golf club teaching and gripping device which may be easily and efficiently manufactured and marketed.

It is a further object of the present invention to provide a new and improved golf club teaching and gripping device which is of durable and reliable construction.

An even further object of the present invention is to provide a new and improved golf club teaching and gripping device which is susceptible of a low cost of manufacture with regard to both materials and labor, and which accordingly is then susceptible of low prices of sale to the consuming public, thereby making such a golf club teaching and gripping device economically available to the buying public.

Even still another object of the present invention is to provide a new and improved golf club teaching and gripping device for properly gripping a golf club without risk of slippage.

Lastly, it is an object of the present invention to provide a new and improved golf club teaching and gripping device including a finger coupling portion dimensioned for receiving fingers on an upper hand of a golfer. A golf club gripping portion is secured to the finger coupling portion. The U-shaped member receives a handle of a golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the present invention.

FIG. 4 is a top plan view of the present invention.

The same reference numerals refer to the same parts through the various Figures.

DESCRIPTION OF THE PREFERRED EMBODIMENT

Figure 1:
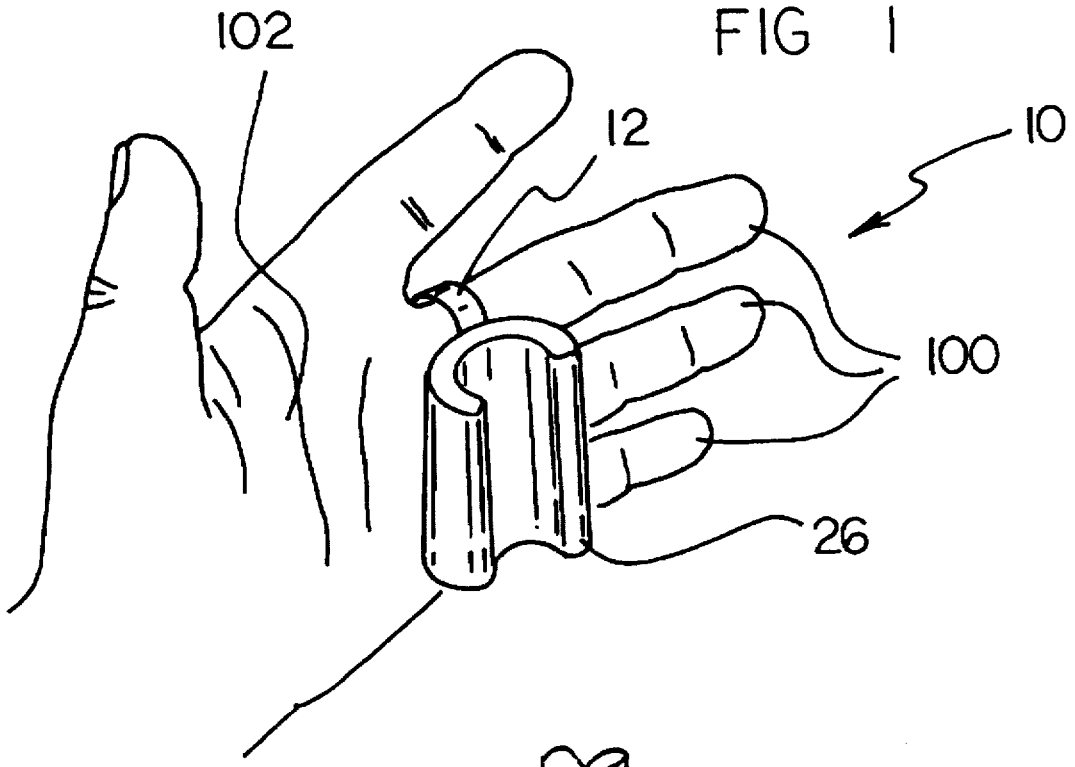
FIG. 1 is a perspective view of the preferred embodiment of the golf club teaching and gripping device constructed in accordance with the principles of the present invention.
Figure 2:
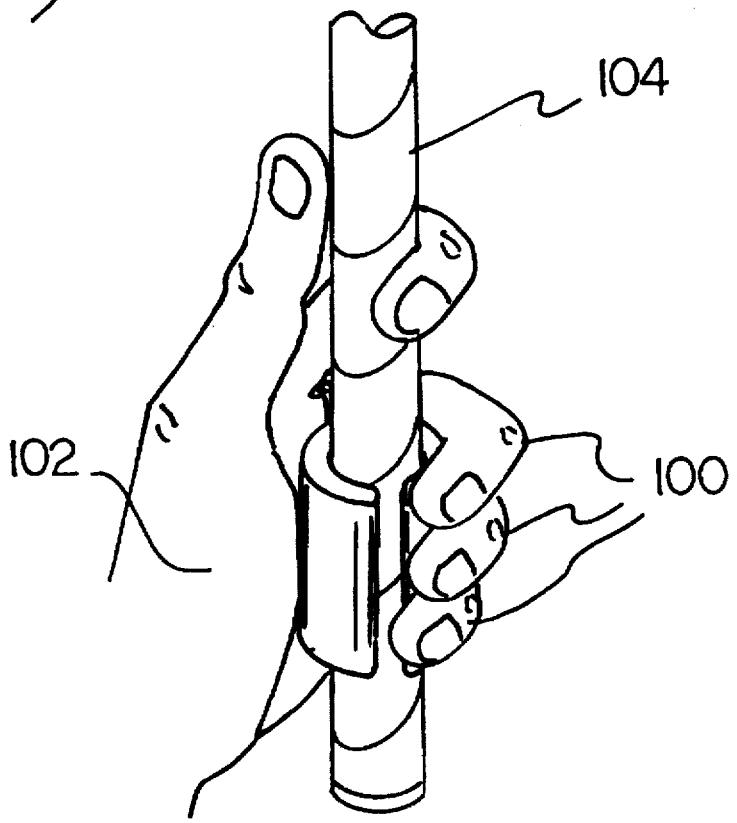
FIG. 2 is a perspective view of the present invention illustrated in use.

With reference now to the drawings, and in particular, to FIGS. 1 through 6 thereof, the preferred embodiment of the new and improved golf club teaching and gripping device embodying the principles and concepts of the present invention and generally designated by the reference number 10 will be described.

Specifically, it will be noted in the various Figures that the device relates to a golf club teaching and gripping device for properly gripping a golf club without risk of slippage. In its broadest context, the device consists of a finger coupling portion and a golf club gripping portion. Such components are individually configured and correlated with respect to each other so as to attain the desired objective.

The device 10 includes a finger coupling portion 12 comprising a resilient ring 14 dimensioned for receiving a last three fingers 100 on an upper hand 102 of a golfer. The resilient ring 14 includes planar inner and outer portions 16,18 and arcuate upper and lower portions 20,22.

Next, the device 10 includes a golf club gripping portion 26 comprising a generally U-shaped member 28 fabricated of a pliable material. In the preferred embodiment, the U-shaped member 28 is fabricated of neoprene or another soft rubber material, natural or synthetic, or a blend thereof. The U-shaped member 28 has an arcuate base portion 30 and a pair of upwardly extending and inwardly curving free portions 32. An outer surface of the arcuate base portion 30 is secured to the planar inner portion 16 of the resilient ring 14 of the finger coupling portion 12. The golf club gripping portion 26 has a length equal to a length of the finger coupling portion 12. The U-shaped member 28 receives a handle 104 of a golf club between the free portions 32 thereof. The coupling of the golf club gripping portion 26 with the handle 104 will encase the handle 104 so that the golf club is held in the proper set-up position for addressing a golf ball to be hit. The golf club gripping portion 26 also serves as an aid for golfing in wet or humid conditions where the slipping of the golf club within the hands is prevalent. The device 10 will prevent any slipping that result from those conditions.

Figure 5:
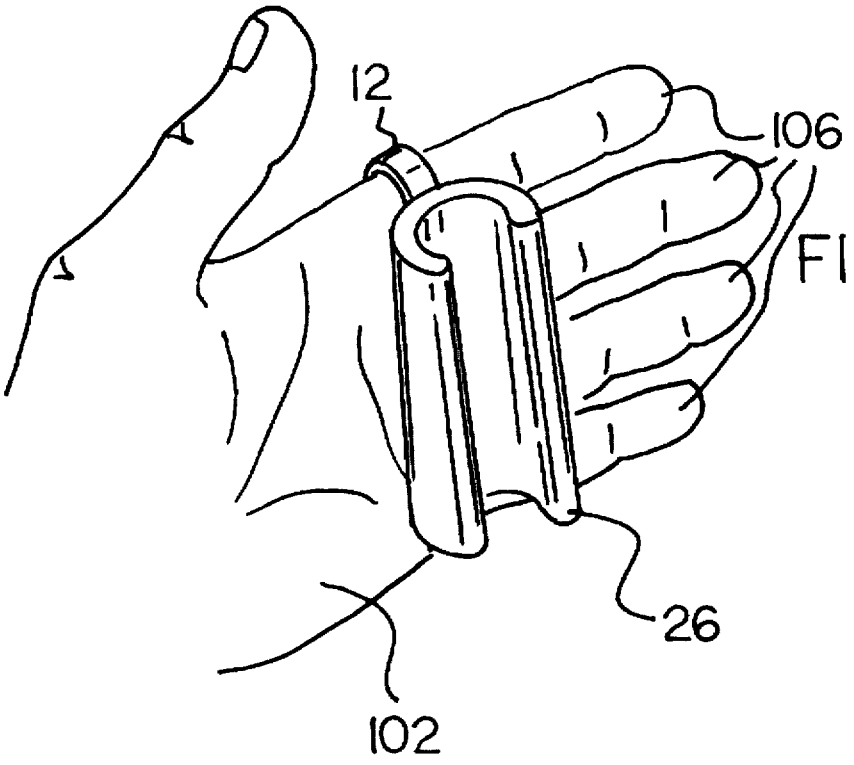
FIG. 5 is a perspective view of a second embodiment of the present invention.
Figure 6:
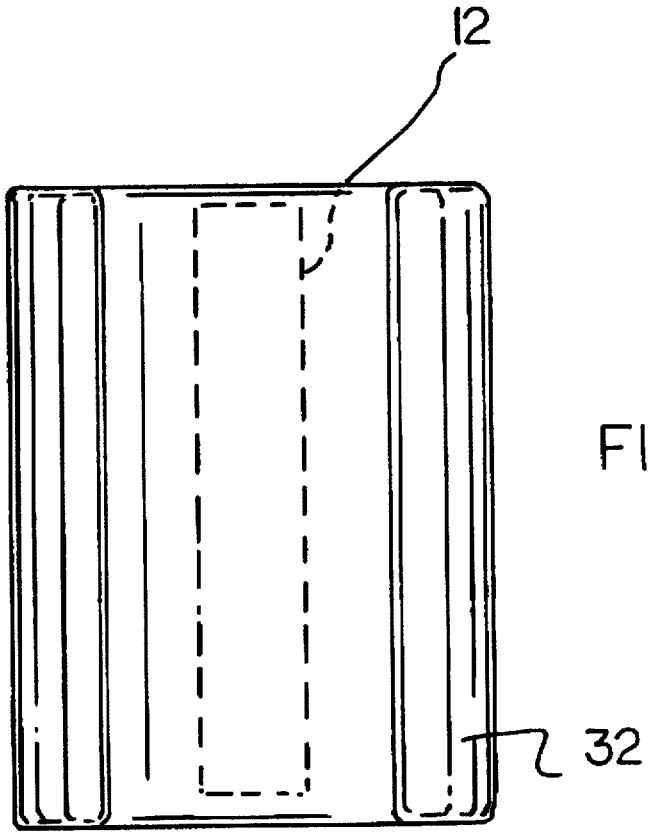
FIG. 6 is a front elevation view of the second embodiment of the present invention.

A second embodiment of the present invention is shown in FIG. 5 and 6 and includes substantially all of the components of the present invention wherein the finger coupling portion 12 is comprised of a resilient ring 14 dimensioned for receiving a last four fingers 106 on the upper hand 102 of the golfer. This embodiment is beneficial to those golfers suffering from an arthritic condition where the gripping of the club is problematic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A golf club teaching and gripping device for properly gripping a golf club without risk of slippage comprising, in combination:

a finger coupling portion comprising a resilient ring dimensioned for receiving at least three fingers on an upper hand of a golfer, the resilient ring including planar inner and outer portions and arcuate upper and lower portions together forming a continuous ring for receiving the finger of the golfer; and a golf club gripping portion comprising a generally U-shaped member fabricated of a pliable material, the U-shaped member having an arcuate base portion and a pair of upwardly extending and inwardly curving free portions, an outer surface of the arcuate base portion secured to the planar inner portion of the resilient ring of the finger coupling portion and extending between the fingers and a palm of the golfer when the finger coupling portion is in place on the upper hand of the golfer, the U-shaped member receiving a handle of a golf club between the free portions thereof for securement to the handle and coupling with the upper hand of the golfer.

* * * * *